US006854985B1

(12) United States Patent
Weiss

(10) Patent No.: US 6,854,985 B1
(45) Date of Patent: Feb. 15, 2005

(54) ELASTOMERIC INTERCONNECTION DEVICE AND METHODS FOR MAKING SAME

(75) Inventor: Roger E. Weiss, Foxboro, MA (US)

(73) Assignee: Paricon Technologies Corporation, Fall River, MA (US)

( * ) Notice: Subject to any disclaimer, the term of this patent is extended or adjusted under 35 U.S.C. 154(b) by 0 days.

(21) Appl. No.: 09/465,056

(22) Filed: Dec. 16, 1999

Related U.S. Application Data

(60) Provisional application No. 60/112,535, filed on Dec. 16, 1998.

(51) Int. Cl.[7] ..... H01R 4/58

(52) U.S. Cl. ..... 439/91; 439/66; 439/74; 439/86; 439/591

(58) Field of Search ..... 439/66, 74, 86, 439/91, 591

(56) References Cited

U.S. PATENT DOCUMENTS 4,003,621 A * 1/1977 Lamp ..... 439/586
4,820,376 A * 4/1989 Lambert et al. ..... 156/643
5,371,654 A * 12/1994 Beaman et al. ..... 361/744
5,618,189 A * 4/1997 Jin et al. ..... 439/91
6,019,610 A * 2/2000 Glatts, III ..... 439/66
6,265,673 B1 7/2001 Higashikia et al. ..... 174/260
6,338,629 B1 1/2002 Fisher et al. ..... 439/66

* cited by examiner

*Primary Examiner*—Truc Nguyen
(74) *Attorney, Agent, or Firm*—Brian M. Dingman, Esq.; Mirick, O'Connell, DeMallie & Lougee, LLP

(57) ABSTRACT

An elastomeric device for interconnecting two or more electrical components, comprising, an elastomeric matrix having one or more outer surfaces; one or more electrically conductive pathways through the matrix; and one or more electrically conductive contact pads, wherein at least a portion of one or more of the pads is flush with or extends outward from one or more of the outer surfaces of the matrix, and wherein at least a portion of the pad is in at least intimate contact with one or more of the pathways; and methods for making same.

59 Claims, 17 Drawing Sheets

(plasma etched)
(prior art)

ELASTOMERIC INTERCONNECTION DEVICE AND METHODS FOR MAKING SAME

This application claims benefit of provisional 60/112,535 filed Dec. 16, 1998.

FIELD OF THE INVENTION

This invention relates to improved conductive elastomer interconnection devices and methods for making them.

BACKGROUND OF THE INVENTION

As electronic systems get smaller, faster and lower cost, the classic methods of separable interconnection need to be replaced with new technologies. One such technology is based on anisotropic conducting polymer materials. Anisotropic Conducting Elastomers (ACE) are elastomers which conduct in one direction but are insulators in the other direction. One such example is ECPI—(Elastomeric Conducting Polymer Interconnect) a material developed by Lucent Technologies—Bell Laboratories. This material is formed by magnetically aligning fine magnetic particles in sheets of uncured silicone such that the particles form arrays of electrically isolated columns. These columns are frozen in place as the silicone cures. When a layer of ECPI is compressed between two electrical conductors the particles in the compressed column come into contact with each other and the conductors, forming an electrically conductive path. Conductivity of the column remains over a compression range which is a function of the material design. This range, often referred to as the material's dynamic range, provides compensation for the lack of coplanarity of the conductors. This is often referred to as "coplanarity compensation".

In a typical application of ACE the interconnect formed replaces the soldered interconnect to allow a separable interconnection. Separable interconnection is generally required for testing the device, conditioning the device (burn-in) and for final application in the OEM product. One such example is in a Land Grid Array (LGA) where an array of pads on a device needs to be connected to a matching array on a board. A second example is when a Ball Grid Array (BGA), consisting of a device with an array of solder balls, is to be separably connected to a matching array on the board. In both of these examples, a layer of ACE material placed between the device and the board can, when properly used, provide a reliable connection.

Further, when using ECPI as an interconnection medium between BGA devices, because the solder balls come in direct contact with the conducting particles on the outer surface of the ECPI, the spherical shape of the solder balls tend to bow the columns of particles outward from the contact center rather than compressing the columns in a straight line. The bowing may cause poor interconnection and shorting between adjacent pads.

Moreover, the behavior of the elastomeric material is critical to the success of the interconnect's performance. Typically highly filled elastomeric material exhibit poor elastic properties, and when formed into discrete button-like contacts, tended to move like putty, taking a severe set. These materials exhibit little residual spring force. These factors impact on the reliability of the contact, and virtually preclude multiple device insertions with different devices. Because these highly filled materials have poor elastic properties, an external spring member is required to create a contact force. However, the elastomer button-like contacts flow continuously under the force. The conventional solution is to limit the flow with a stop. The net effect is a very low contact force. In addition, elastomers in sheet form may have excellent elastic properties but tend to behave like incompressible fluids. This behavior demands that the connector system design provide for a place for the material to move.

Another problem arises because, unlike conventional pin-in-socket contacts which provide for a metal to metal wiping action as the pin mates with the socket, elastomeric contacts tend to provide no wipe. This wiping action breaks through surface contaminants and corrosion products, such as oxides and sulfides. Moreover, improper selection of contact materials, such as solder against a gold plated particle, can result in the gold dissolving in the solder and forming a brittle alloy which will break and form a type of insulating layer referred to as fretting corrosion.

The above described limitations to the capability of conventional elastomeric conducting materials may, to a varying extent, be applied to both anisotropically conducting elastomeric materials that have magnetically aligned particles, and isotropically conducting materials such as those that are heavily filled with conducting metal. These limitations also apply to some extent to anisotropic elastomeric materials that utilize other means than the magnetic alignment of particles to provide electrical and/or thermal connection.

SUMMARY OF THE INVENTION

The device and methods of the invention provide unique improvements to both anisotropic and isotropic conductive elastomers, and more specifically to ECPI, which enhance performance and reliability and to broaden their range of applications. These improvements include, but are not limited to, improved polymer materials, unique surface geometries and improved connectors housing the polymers. Unlike previous ECPI, the devices and methods of the invention utilize metal contact pads which are compatible with the underlying conductive particles of the ECPI; and the elastomeric material of the device facilitates penetration of unwanted contaminants using the nodular structure of the particles at the surface of the elastomer or by asperities formed on the pads.

It is therefore a primary object of this invention to provide a device, for anisotropically or isotropically interconnecting two or more components, which enhances the quality and reliability of the interconnection.

It is a further object of this invention to provide a device, for interconnecting two or more components, which is capable of repeated use for testing, conditioning and final application of the components.

It is a further object of this invention to provide a device, for interconnecting two or more components, having an outer surface which is durable and readily cleaned.

It is a further object of this invention to provide a device, for interconnecting two or more components, capable of being selectively coated with metals or solders which are compatible with opposing component surfaces to prevent fretting corrosion, to improve the interconnection and to improve the versatility of the device.

It is a further object of this invention to provide a device, for interconnecting two or more components, such as a Ball Grid Array and a board, which prevents the conductive columns of particles of the device from bowing when compressed between the components.

It is a further object of this invention to provide a device, for interconnecting two or more components, which provides flow space into which the elastomer materials in the device may flow under compression.

It is a further object of this invention to provide a device, for interconnecting two or more components, which provides additional surface features, including one or more contact pads, which protect the underlying conductive particles and improve conductivity between the device and the opposing components.

It is a further object of this invention to provide a device, for interconnecting two or more components, comprising one or more contact pads on which one or more asperities are formed to penetrate any oxide layer formed on an opposing component and to improve the interconnection.

It is a further object of this invention to provide a device, for interconnecting two or more components, comprising one or more contact pads, fixed to the matrix of the device, which prevent the underlying conducting particles at the outer surface of the matrix from dislodging.

It is a further object of this invention to provide a device, for interconnecting two or more components, comprising one or more contact pads on which one or more layers of metal are formed to improve the interconnection.

It is a further object of this invention to provide a device, for interconnecting two or more components, comprising one or more floating contact pads capable of being separably applied to an underlying conductive matrix.

A preferred embodiment of the elastomeric device of the invention for electrically interconnecting two or more components, comprises: an elastomeric matrix having one or more outer surfaces; one or more electrically conductive pathways through the matrix; and one or more electrically conductive contact pads, wherein at least a portion of one or more of the pads is flush with or extends outward from one or more of the outer surfaces of the matrix and, wherein at least a portion of the pad is in at least intimate contact with one or more of the pathways. The matrix preferably comprises one or more elastomers which retains about 90% or more of its modulus of compression over a temperature range of between about −50° C. to 200° C. The device may further comprise one or more means for providing flow space into which at least a portion of the matrix may flow under compression; wherein the means for providing flow space may comprise one or more of the following: one or more microspheres imbedded in the matrix; one or more spaces formed between two or more of the pads which extend outward from the surface of the matrix; one or more spaces formed between a plurality of raised surface asperities on one or more of the outer surfaces of the matrix; and one or more gas particles (a bubble of controlled size) located in the matrix. In the latter instance, the pathways may also comprise one or more conducting particles and wherein the gas particles are of a size which is about 20% or less than the size of the conducting particles.

The device may also further comprise one or more asperities on one or more of the outer surfaces, wherein the means for providing flow space comprises one or more spaces formed between two or more of the asperities; and/or wherein one or more of the pathways comprises a plurality of electrically conductive particles, wherein one or more of the particles extends outward from one or more of the outer surfaces, and wherein the means for providing flow space comprises one or more spaces formed between two or more of the particles extending outward from the one or more of the surfaces.

The elastomeric matrices may be isotropic or anisotropic, where, in the latter instance, the matrices preferably comprise between about 5 to 25% magnetic particles by volume of the elastomeric matrix; wherein a plurality of the magnetic particles are preferably aligned to form one or more arrays of electrically isolated columns having at least one end, wherein one or more of the pads is in contact with an end of one or more of the columns of particles. In a device wherein one or more of the pathways comprises a plurality of particles aligned to form a column having at least one end and wherein one or more of the pathways is anisotropic, one or more of the pads is preferably in contact with at least one of the ends of one or more of the columns of particles.

One or more of the pads may comprise one or more layers of a conductive material, preferably metal, in at least intimate contact with one or more of the outer surfaces of the matrix; and may together form an array of electrically conductive pads across one or more of the outer surfaces of the matrix. One or more of the pads may further comprise one or more outer surfaces comprising one or more asperities. The pads may be applied to the matrix by sputtering, vapor deposition, plating, bonding or a combination of these techniques.

In applications wherein at least one of the components is a circuit board comprising an array of electrical contact points, (lands), the array of pads preferably corresponds to the array of contact points on the board. In applications wherein at least one of the components is a heat sink, the pathways are isotropic to conduct heat away from the circuit board to the heat sink. In applications wherein at least one of the components is a ball grid array comprising an array of solder balls, the array of pads preferably corresponds to the array of solder balls.

As noted one or more of the pathways of conductive particles comprises a plurality of electrically conductive particles aligned in a column. These particles may have at least one end particle coated with a metal, wherein the portion of the pad, that is in at least intimate contact with one or more of the pathways, is preferably in contact with the coated end particle and is coated with one or more metals that is compatible with the metal coating on the end particle; wherein one or more of the pads preferably forms a bond with the matrix and with one or more of the end particles.

The outer surfaces of the matrix typically comprises a first surface adapted to face one of the components and a second surface adapted to face a second of the components, wherein one or more of the pathways extends from at least proximate to the first surface to at least proximate the second surface and wherein one or more of the pads are located on the first and second surfaces.

The device of the invention may further comprise one or more support films; wherein at least one of the support films is preferably a carrier sheet; wherein at least one of the support films is preferably removable; wherein one or more of the components may comprise registration holes, and wherein at least one of the films comprises one or more registration holes in the film which correspond to the registration holes of the component and through which one or more alignment members, such as a precision pin, may be passed. In instances wherein one or more of the components comprises registration holes, one or more of the films may comprise one or more precision pins which correspond to one or more of the registration holes of the components. At least one of the films may comprise one or more mounting holes in the film which are at least partially filled with the elastomeric matrix; and/or at least one of the films comprises one or more contact holes may be adapted to receive therein at least one or more of the pads, wherein at least one or more of the pads may have an outer surface which protrudes from the contact holes. In instances wherein at least one of the films is removable, the removable film, if removed, will preferably leave behind spaces between two or more of the pads into which at least a portion of the matrix may flow when compressed.

The pads of the device may be mounted to the matrix as an applique, wherein one embodiment of the applique comprises a support layer which holds one or more of the pads in one or more predetermined locations in the support layer; and wherein one or more of the pathways may comprise a plurality of conducting particles aligned in one or more columns having at least one end particle proximate one or more of the outer surfaces of the matrix, wherein the predetermined locations correspond to one or more of the end particles. The support layer may comprise two opposing sides, wherein one or more of the pads which is held in the support layer comprises two opposing ends portions which are larger in diameter than a middle portion, wherein the holes of the support layer have a diameter which is smaller than the diameters of the opposing ends, and wherein the larger opposing end portions of one or more of the pads extend outward from the opposing sides of the support layer and the middle portion of the pad is captured in the hole. The middle portion of the pad preferably has a length, wherein the pad is capable of floating up and down in the hole to the extent of the length of the middle portion. The floating pads are preferably brass. Alternatively, the floating pads may be molded plastic comprising one or more conductive layers, wherein the conductive layers comprise a layer of copper and one or more subsequent layers of nickel and solder or gold. The floating pads may likewise comprise one or more asperities in one or more of the pad surfaces.

The preferred method of the invention, for making an elastomeric device for electrically interconnecting two or more components, comprises the steps of: embedding a plurality of conductive, magnetic particles in an elastomer which retains 90% of its modulus of compression over a temperature range of between about −50° C. to 200° C. by mixing the particles in the elastomer before the elastomer sets and applying a magnetic force to the particles so that the particles align themselves in electrically isolated columns as the elastomer sets to form an elastomeric matrix having one or more outer surfaces and comprising one or more electrically conductive pathways through the matrix; providing one or more electrically conductive contact pads; and fixing one or more of the electrically conductive contact pads to the matrix, so that at least a portion of one or more of the pads is flush with or extends outward from one or more of the outer surfaces of the matrix and, so that at least a portion of the pad is in at least intimate contact with one or more of the pathways. The method may further comprise the step of creating one or more means for providing flow space into which at least a portion of the matrix may flow under compression, wherein the step of creating one or more means for providing flow space comprises embedding one or more microspheres in the elastomer as its sets to form the matrix; forming a plurality of raised surface asperities in one or more of the outer surfaces of the matrix as the elastomer sets; and/or trapping one or more gas particles in the matrix as the elastomer sets. One or more of the pads comprises one or more layers of metal in at least intimate contact with one or more of the outer surfaces of the matrix and one or more of the pathways.

The conductive pathways used in the method of the invention may be anisotropic and may comprise up to about 25% magnetic particles by volume of the elastomeric matrix, wherein a plurality of the columns of magnetic particles has at least one end particle proximate one or more of the outer surface of the matrix, and wherein one or more of the pads is in intimate contact with an end particle of one or more of the columns of particles. The conductive pathways preferably comprise at least about 3% magnetic particles by volume of the elastomeric material. The elastomeric matrix may alternatively be isotropic and comprise at least one end particle wherein one or more of the pads is in intimate contact with at least one of the particles in the matrix.

If an applique of pads is used in the method, the pads may be of a known number and may comprise two opposing end portions having a diameter and a middle portion having a diameter smaller than the diameter of the end portions, and wherein the step of providing one or more electrically conductive contact pads comprises the steps of, providing one or more non-conductive, pliant support sheets comprising a plurality of holes, having a diameter smaller than the diameter of the end portion of the pads, through the sheet corresponding to the number of pads; and pushing one of the opposing ends portions of each of the pads through one of the holes so that the pad is captured in the sheet.

The device of the invention may be incorporated into a device package, wherein one or more chips and one or more components are electrically interconnected, comprising: one or more layers of elastomeric material between the chip and the component, wherein at least one of the layers provide electrical contact between the chip and the component, and wherein the layer which provides electrical contact comprises, an elastomeric matrix having one or more outer surfaces; one or more electrically conductive pathways through the matrix; and one or more electrically conductive contact pads, wherein at least a portion of the pad is in at least intimate contact with one or more of the pathways.

Another preferred embodiment of the device of the invention incorporated into a device package, wherein one or more chips and one or more heat sinks are interconnected so that heat may be transferred from the chip to the heat sink, comprises: a can having a first and second opposing surface, wherein the first opposing surface is adjacent to the heat sink; a top layer of elastomeric material provided between the chip and the second opposing surface of the can, wherein the top layer provides thermal contact between the chip and the can; a bottom layer of conducting elastomeric material between the chip and a lead frame, wherein the bottom layers provides electrical contact between the chip and the lead frame; wherein the bottom layer preferably comprises elastomeric conducting polymer interconnect.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED METHOD

The elastomeric device of the invention, for electrically interconnecting two or more components, generally includes the following basic elements: an elastomeric matrix having one or more outer surfaces; one or more electrically conductive pathways through the matrix; and one or more electrically conductive contact pads, wherein at least a portion of one or more of the pads is flush with or extends outward from one or more of the outer surfaces of the matrix and, wherein at least a portion of the pad is in at least intimate contact with one or more of the pathways. As described below, each of these basic elements may be modified to suit a particular application and/or to optimize certain features of these elements. Generally, the device may include pads which are integral with the matrix and/or pads which are separable, as in an array of pads which are mounted to the matrix as an appliqué.

Integrated Surface Pads

Figure 1A:
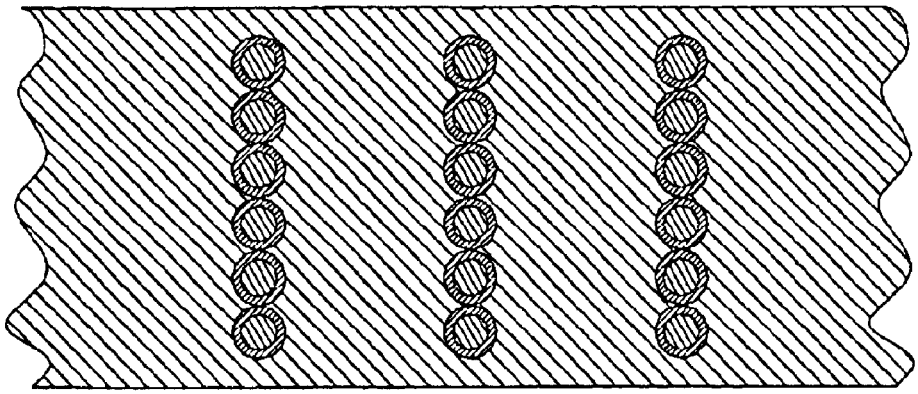
FIG. 1a (prior art)
FIG. 1A is a partial cross-sectional view of a prior art elastomeric conductor using magnetically aligned particles.
Figure 1B:
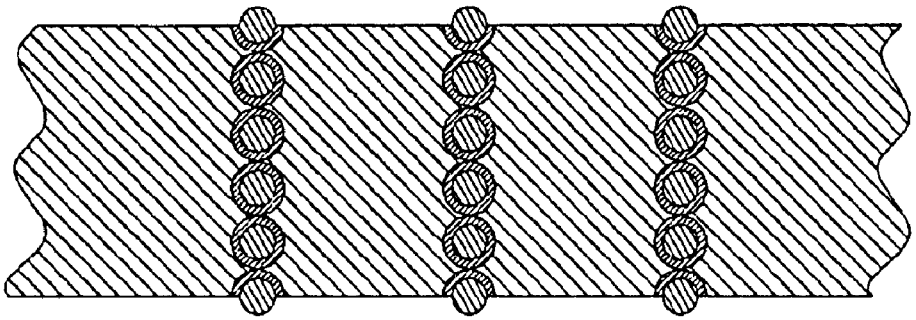
FIG. 1B is a partial cross-sectional view of the prior art conductor of FIG. 1A plasma etched to expose the outer surface of the conductive particles embedded therein.

FIG. 1A is a cross-section of the typical elastomeric conductor of the prior art using magnetically aligned conducting particles. As shown in FIG. 1A, a thin layer of polymer material remains on the surface after manufacturing which must be penetrated by the particles as the conductor is squeezed between two components. FIG. 1B shows the thin polymer material etched away in a manner taught by U.S. Pat. No. 4,820,376, "Fabrication of CPI Layers". When exposed, the particles are quite fragile and the material must be handled very carefully to prevent the particles from dislodging.

Figure 2:
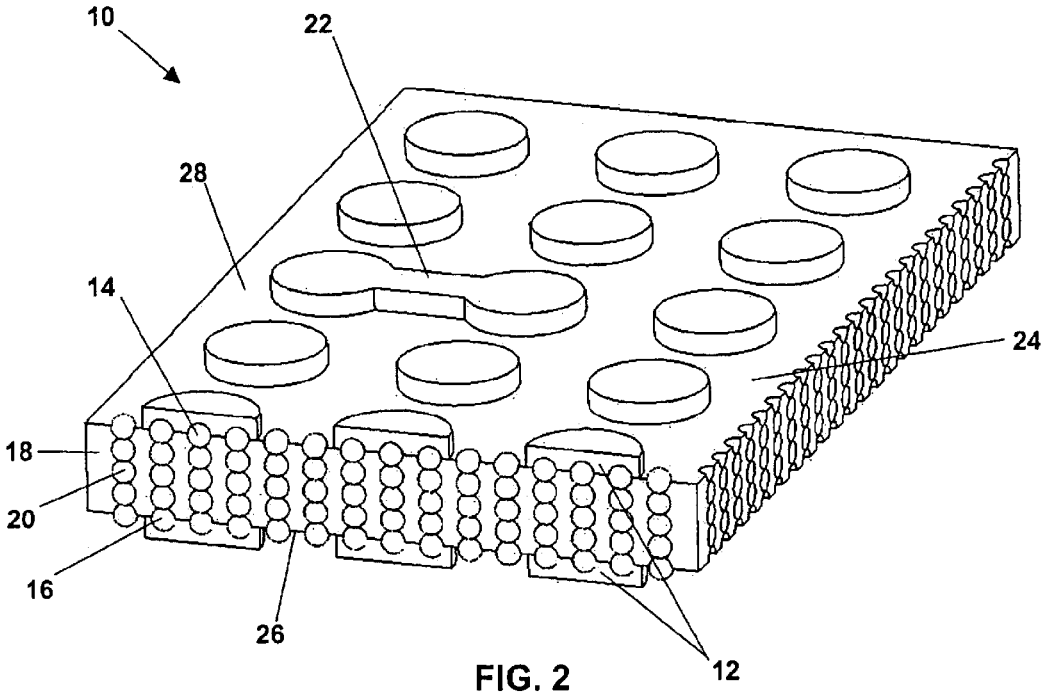
FIG. 2 is a partial perspective cross-sectional view of the device of the invention.

The preferred embodiment of the device of the invention is shown and generally referred to in FIG. 2 as device 10. Device 10 comprises an array of integral conducting pads 12 formed on the surfaces 24 and 26 of matrix 18 and in intimate contact with the surfaces and one or more conducting particles such as particles 14 and 16, each located at the end of a column of magnetically aligned particles such as column 20. Device 10 may also include other surface features such as routing path 22. The array of pads 12 can be formed by sputtering, vapor deposition, plating, bonding or a combination of these methods that are well understood by those skilled in the metal surface formation industries. The pads may be formed directly on the surface of the elastomer or as an applique on a separate sheet and subsequently bonded to the elastomer as described later in this disclosure.

The resulting pad(s) form a bond between the silicone of matrix 18 and the end particles of the columns of conducting particles. The pads protect the end particles and keeps them from dislodging from the matrix. The pads also serve as extended electrical contact area improves the overall efficiency of an electrical connection. This geometry is particularly well suited for interconnecting BGA devices. Each solder ball on the BGA may now contact a matching pad on matrix 18, which, in turn, is in contact with an end particle of several conducting particle columns. This design allows the device to be compressed between the BGA and a circuit board without causing the columns of conducting particles to bow as frequently happens when the typically round solder balls of the BGA are compressed directly against the ends of the columns of conducting particles of the devices shown in FIGS. 1A and 1B.

Although device 10 comprises pads on both surfaces of matrix 18, it is envisioned that pads and other surface features may be formed on one or both surfaces and may facilitate a multiplicity of electrical paths throughout matrix 18 and across the surface of matrix 18 to augment the routing provided by the device and a board or other component.

The pad structure provides a readily cleaned protective layer, which greatly increases the usable life of the material. Furthermore, a secondary cleaning operation of the plasma etched material with integral pads will remove the surface particles from unwanted areas while leaving the particles only in the pad area. This will minimize the opportunity for unwanted electrical contact.

The thickness of pads 12, and thus the height of pads 12 which extends outward from the outer surfaces of matrix 18, forms spaces, e.g. space 28, between adjacent pads into which the polymer of matrix 18 may flow or bulge as the polymer material is compressed between two opposing components. Spaces, such as space 28, allow the elastomeric material to be used in applications where no local expansion space is provided, such as with designs using solder mask around the lands, which causes the lands to be coplanar or recessed relative to the surface of the solder mask.

The outer surface of the pad may be structured so as to optimize the interconnection with the opposing component. The pad's outer surface may be finished with solder, gold or any material that is an optimum match of the opposing member. Different finishes may be provided on opposing surfaces of the pads to facilitate the interconnection between normally inappropriate materials, such as solder to gold.

Figure 3:
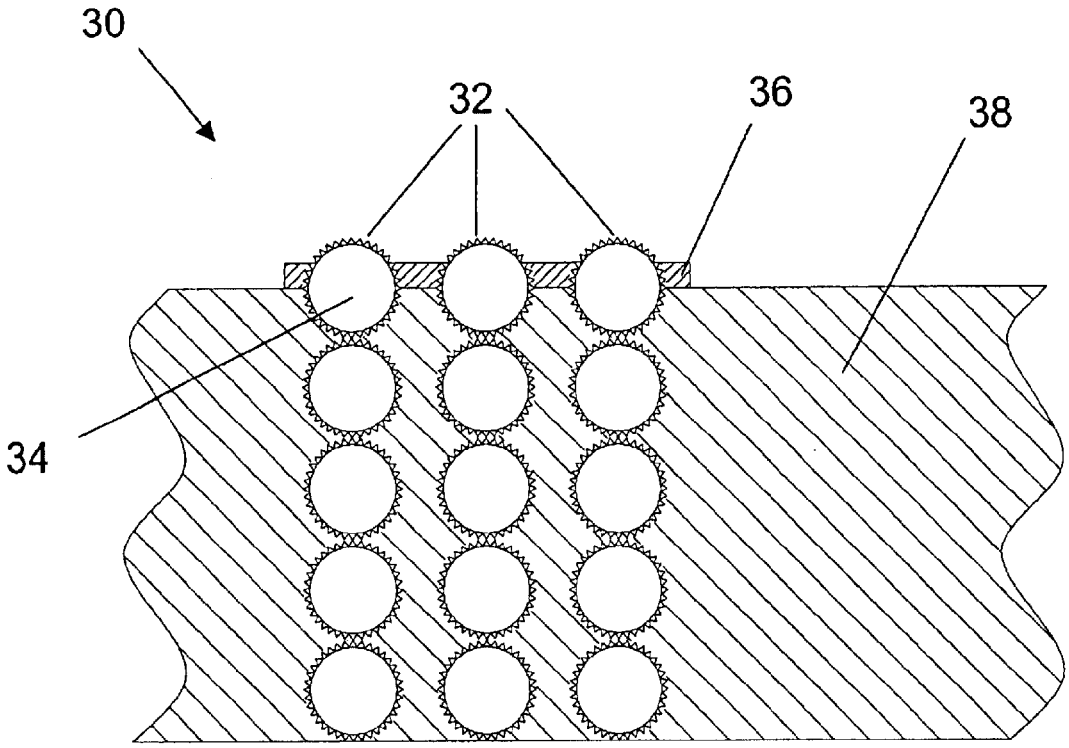
FIG. 3 is a partial cross-sectional view of another preferred embodiment of the device of the invention.
Figure 4:
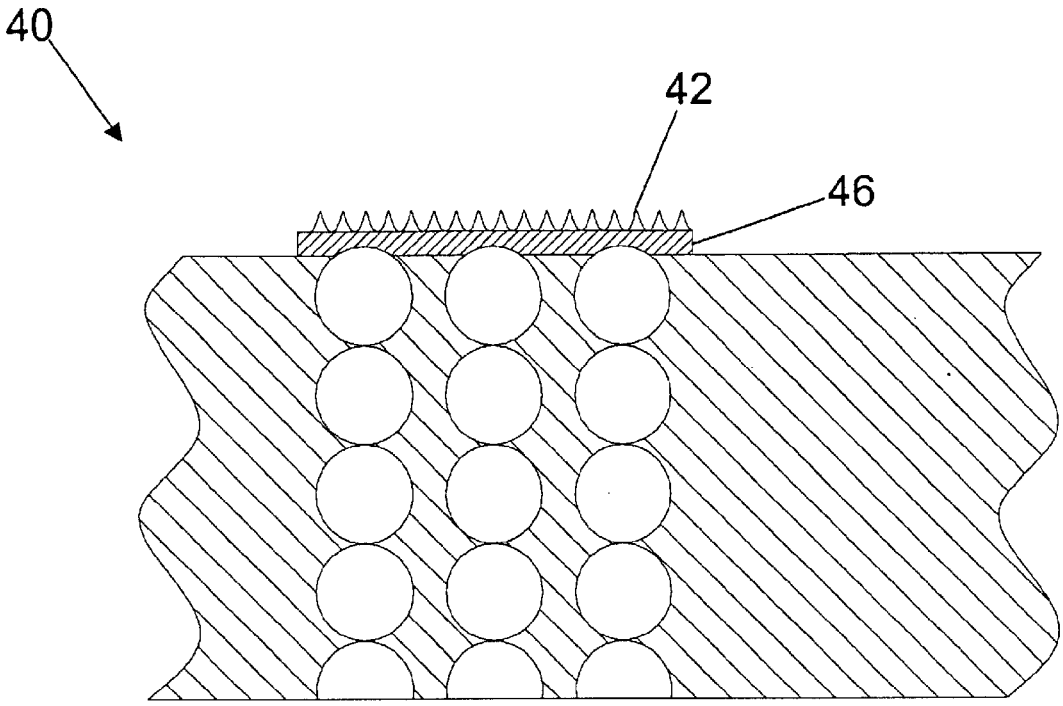
FIG. 4 is a partial cross-sectional view of another preferred embodiment of the device of the invention.
Figure 5:
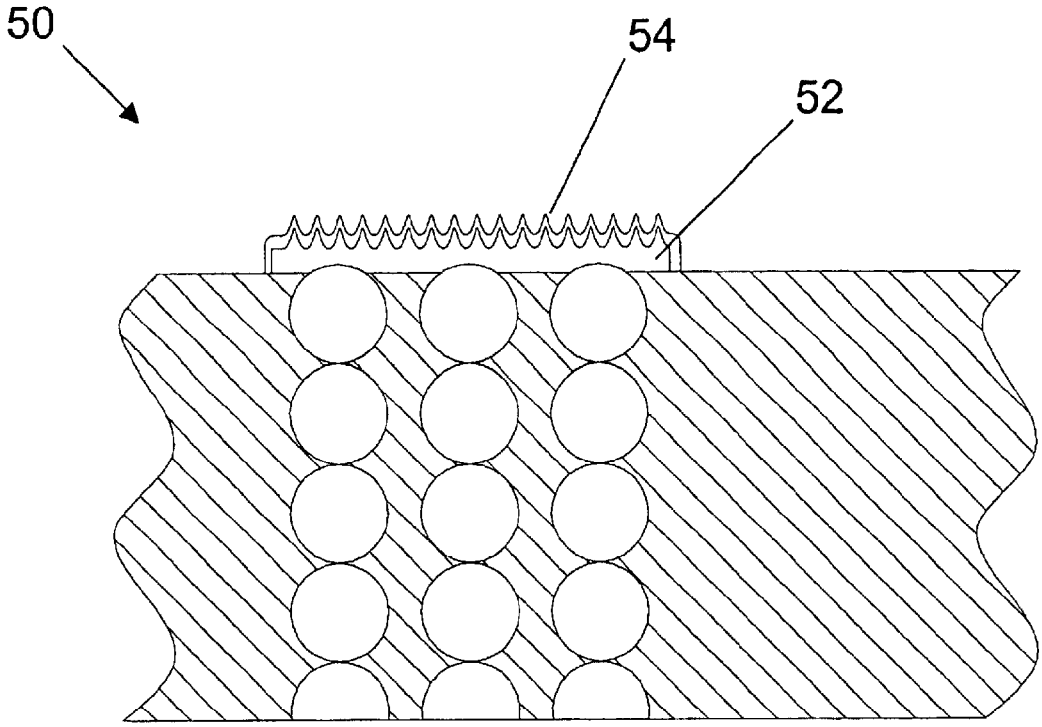
FIG. 5 is a partial cross-sectional view of another preferred embodiment of the device of the invention.
Figure 6A:
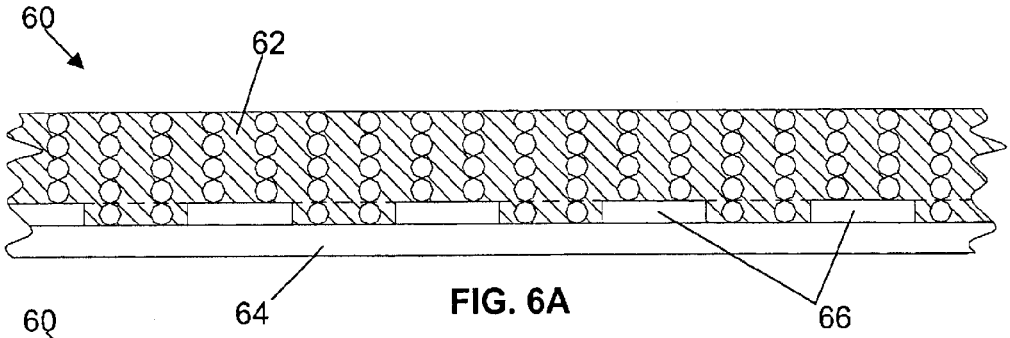
FIG. 6A is a partial cross-sectional view of another preferred embodiment of the device of the invention.
Figure 6B:
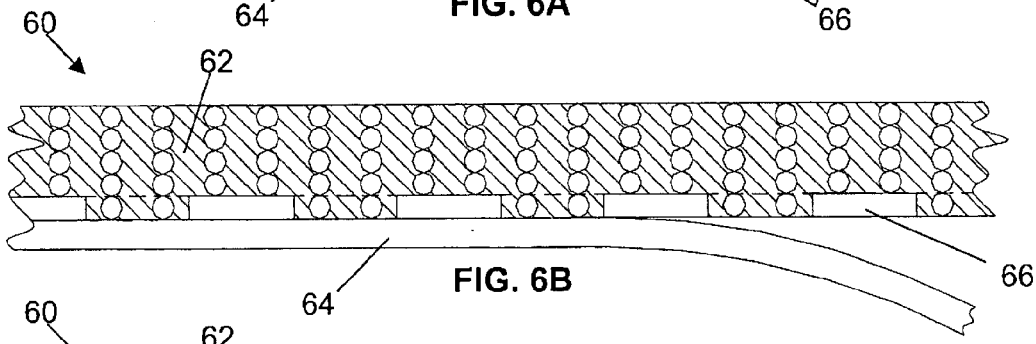
FIG. 6B is a partial cross-sectional view of the device of FIG. 6A with the carrier partially removed.
Figure 6C:
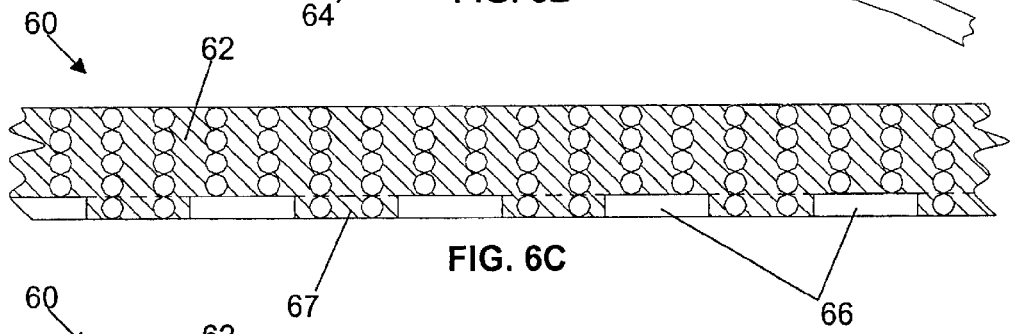
FIG. 6C is a partial cross-sectional view of the device of FIG. 6A with the carrier completely removed.
Figure 6D:
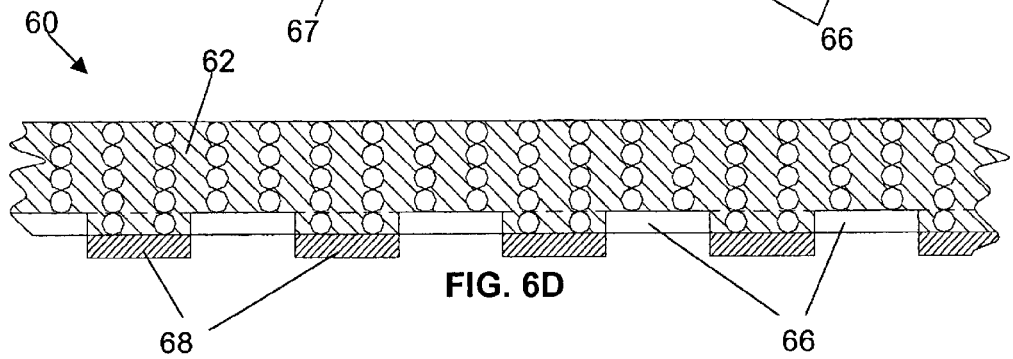
FIG. 6D is a partial cross-sectional view of the device of FIG. 6A with the carrier completely removed and the outer surface of the pads are plated.

Asperities may be desired and formed on the surface of the pads to puncture any oxide layers on the surface of the opposing components and to provide a more reliable interconnection. The asperities may be formed on the pad surface by various means, as shown in FIGS. 3–5. As shown by device 30 in FIG. 3, if the pad 36 is thin relative to the surface particles 34, asperities 32 are formed by virtue of the sharp edges of the underlying particles embedded in matrix 38 which protrude from the outer surface of the pad. In instances where the thickness of the pad prevents the particles from protruding, a secondary plating step may be used to form dendrites 42 on the outer surface of the pad 46 of device 40 (FIG. 4). The dendrites may be formed using the plating method taught in U.S. Pat. No. 5,185,073 or by forming diamond shards on the surface as taught in U.S. Pat. No. 5,835,359. Alternatively, chemical or mechanical methods, such as etching and sand blasting, may be employed to roughen the base metal of the surface of pad 52 of device 50 while having little effect on the surrounding elastomer. A subsequent thin plating 54 of a hard metal such as nickel followed by a thin surface plate will provide an ideal surface which is well populated with asperities (FIG. 5).

Typically, the device testing arena requires conducting elastomers which have a very robust and easily cleaned surface to optimize the maximum cycle life of the elastomers. In the present invention, the pad, by covering the end particles, provides such as surface as a durable conductor surface. Moreover, the surface of the elastomer matrix, in between the pads, may be coated with a debris resistant film such as a flexible solder mask which is also durable and readily cleaned.

In the normal construction of an elastomeric conductive sheet, a carrier film such as a 0.005 inch thick layer of Mylar is used to carry the elastomeric film through the manufacturing process. This carrier sheet is normally removed from the elastomer at the end of the assembly. In yet another embodiment of the device of the invention, shown and generally referred to in FIGS. 6A–6D as device 60 comprising matrix 62, the carrier sheet 64 is modified with an additional thin support film 66. Support film 66 has holes formed in it corresponding to the pattern of the contacts. For example, the film may comprise a 0.002 inch thick film of Kapton with 0.025 inch holes formed on 0.050 inch centers. Other features such as registration and mounting holes may also be formed in the support sheet.

When the elastomeric matrix is formed it will fill the holes in support film 66. When carrier sheet 64 is removed from support film 66 (FIG. 6B), a structure comprising elastomeric matrix 62 and support film 66 remains. The support film seals the surface of the elastomeric matrix and particles embedded therein and provides additional dimensional stability to the structure. The exposed pads 67 are then etched and plated, e.g. plate 68, as described earlier, with aspirates as needed. The resulting structure (FIG. 6D) provides a stable, sealed surface which can be readily cleaned. This structure facilitates repeated use as needed for test sockets and burn-in sockets.

Figure 7:
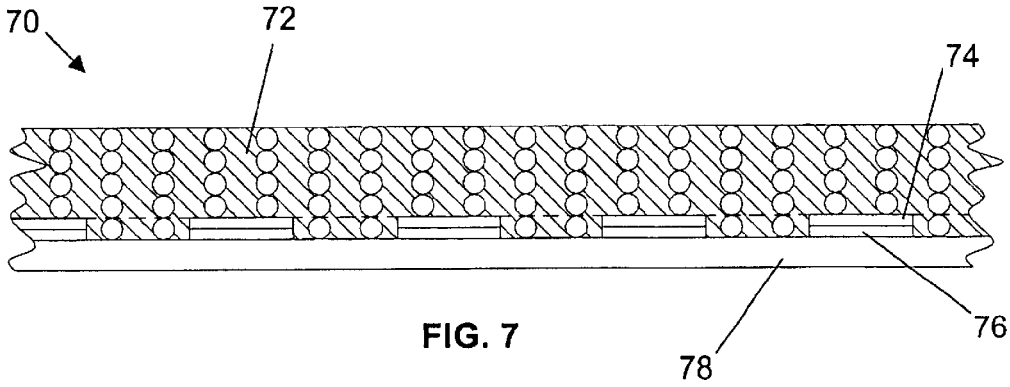
FIG. 7 is a partial cross-sectional view of another preferred embodiment of the device of the invention.
Figure 8:
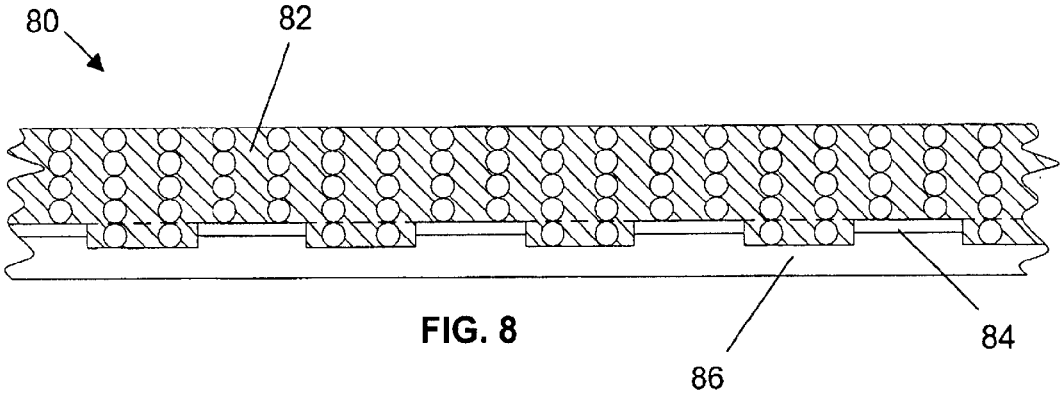
FIG. 8 is a partial cross-sectional view of another preferred embodiment of the device of the invention.
Figure 9:
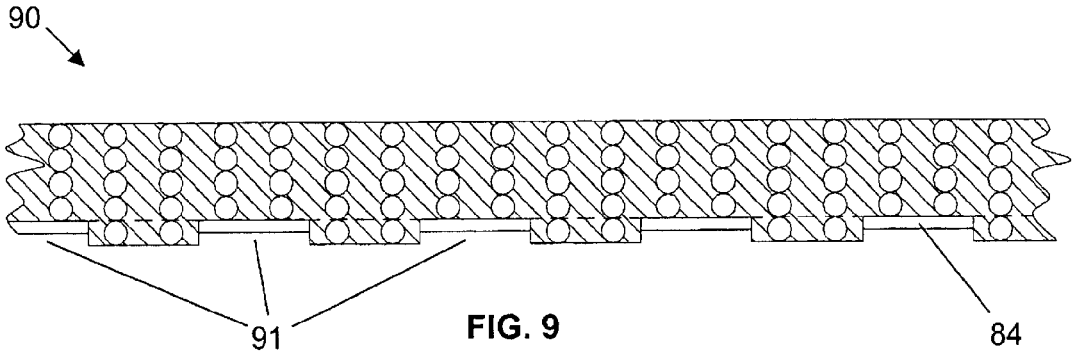
FIG. 9 is a partial cross-sectional view of another preferred embodiment of the device of the invention.
Figure 10:
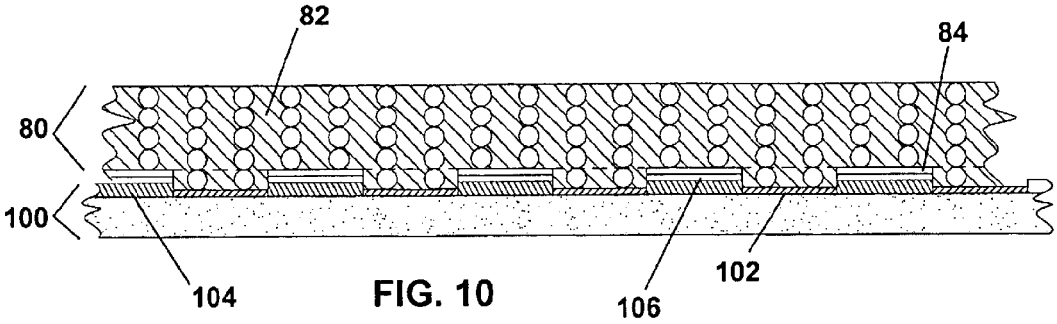
FIG. 10 is a partial cross-sectional view of another preferred embodiment of the device of the invention.

In yet another preferred embodiment, shown and generally referred to in FIG. 7 as device 70, device 70 comprises matrix 72, carrier sheet 78 and two additional support films 74 and 76. Device 80 (FIG. 8) comprises matrix 82, support film 84 and modified carrier sheet 86. When sheet 78 and film 76 or modified sheet 86 are removed from their respective devices small spaces, e.g. spaces 90, are left between the surface of the pads and the surrounding area, as shown in FIG. 9. The spaces serve two purposes: they allow the device to access lands 102 on the opposing component 100 which are surrounded by solder mask 104 and are depressed relative to the solder mask (FIG. 10) and it also provides a space 106 for the elastomer to flow to during compression. The protruding pads may or may not be metalized as described earlier based on the application.

Figure 11:
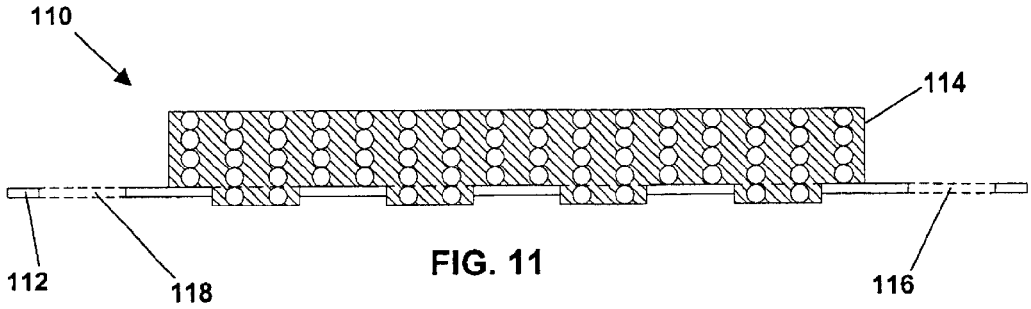
FIG. 11 is a partial cross-sectional view of another preferred embodiment of the device of the invention.

Registration of the array of pads to the lands can be achieved by the addition of other features to the Kapton sheet. In one such preferred embodiment shown and generally referred to in FIG. 11 as device 110, four precision registration holes are placed in the Kapton sheet 112 outside matrix 114 and array of pads, e.g. registration holes 116 and 118. Fewer or more registration holes may be employed depending on the application. These holes match four equivalent holes in the opposing component such as a printed wiring board. Alignment of the pads on the matrix to the lands on the board is facilitated with precision pins pressed through the holes in the Kapton into the matching holes in the printed wiring board. These precision pins can be molded into the device alignment frame which provides alignment of the device to the board in a single molded piece part. Any elastomeric material covering the registration holes in the Kapton should be easily penetrated by the pins. Alternatively, the matrix may be die cut and predetermined section removed from the carrier sheet. Other features, such as registration slots, can be added to the Kapton sheet to align it with the connector housing, support frames or other alignment and support devices commonly used.

Figure 12:
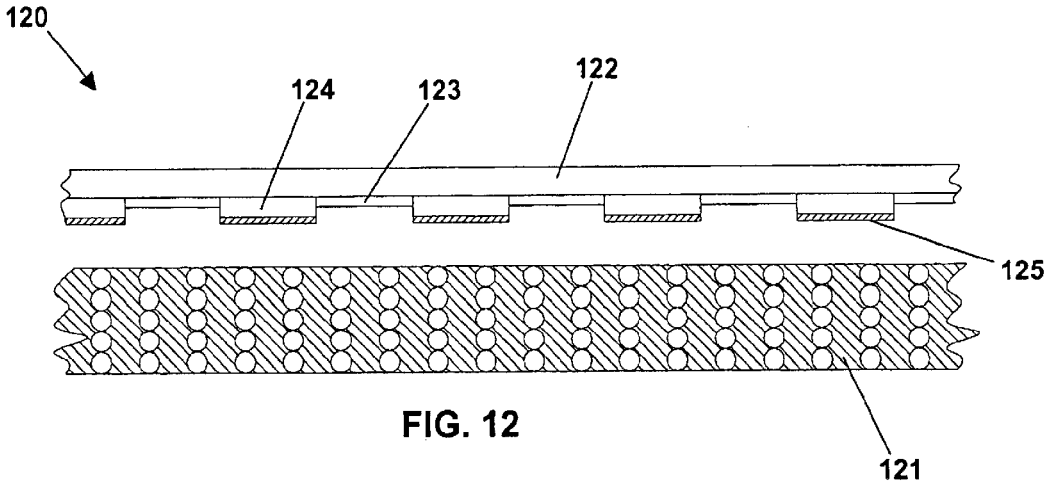
FIG. 12 is a partial cross-sectional view of another preferred embodiment of the device of the invention.

In yet another preferred embodiment shown in FIG. 12, the array of pads 124 are formed by well understood methods on a separate carrier sheet 122. In this embodiment, a Kapton sheet 123 may also be attached to carrier sheet 122 which is in intimate contact with the pads and contains registration holes 116 and 118. The pads are copper and are coated with conductive adhesive 125. The carrier sheet assembly is laminated to a sheet of ECPI 121 bonding the pads to the ECPI sheet. The carrier sheet is peeled away leaving the pads and Kapton sheet attached to the ECPI.

Figure 13:
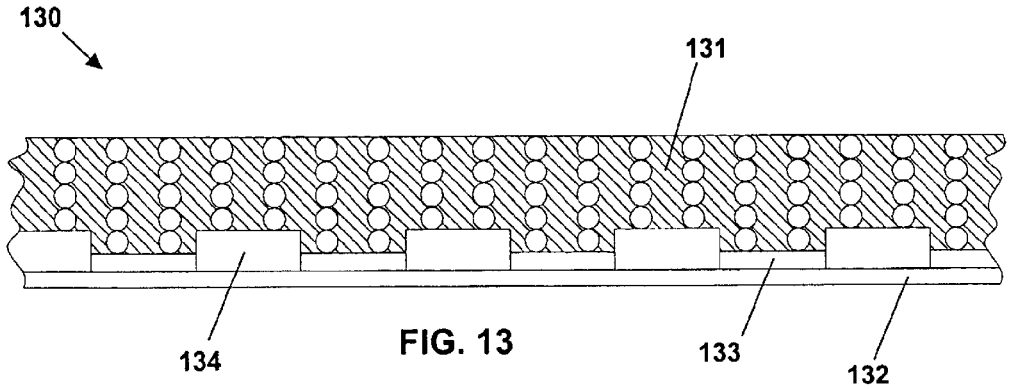
FIG. 13 is a partial cross-sectional view of another preferred embodiment of the device of the invention.

In another preferred embodiment shown in FIG. 13, carrier sheet 133 with Kapton 133 and copper pads 134 is built without the conductive adhesive. Sheet 133 is coated with the uncured ECPI formulation and run through the ECPI manufacturing process. The resulting sheet of ECPI 131 is intimately bonded to the copper pads and Kapton carrier sheet. The carrier sheet is peeled away leaving the pads and Kapton sheet attached to the ECPI.

As previously noted, although the device 110 has pads on only one surface, the device may be modified to provide pads on both surfaces, with the support film on one or both sides of the elastomeric matrix. The structure described above can be combined in several ways to address the interconnection needs of a specific application.

Separable Surface Pads

Figure 14:
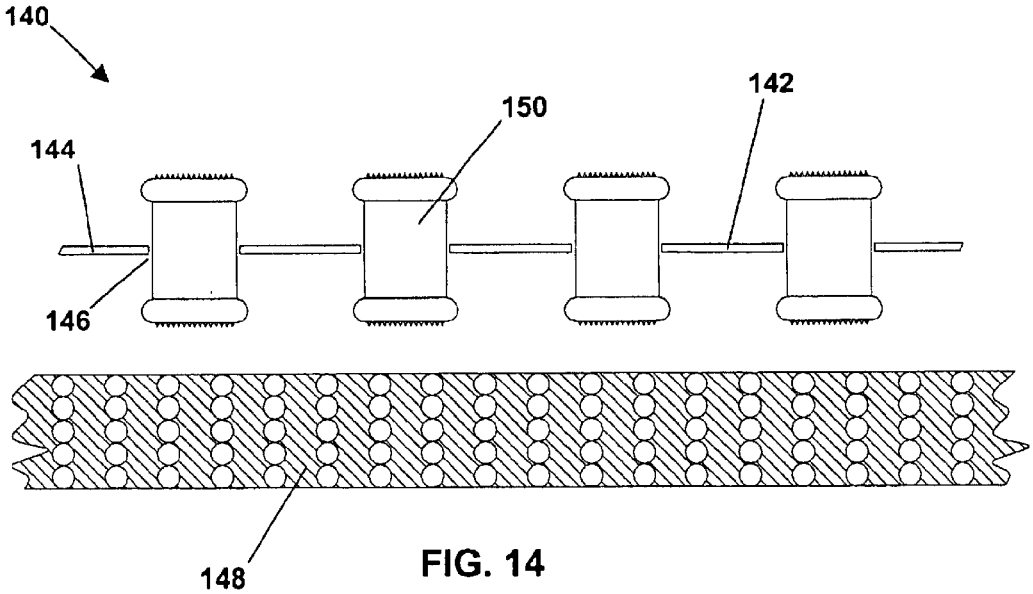
FIG. 14 is a partial cross-sectional view of another preferred embodiment of the device of the invention comprising an applique of floating pads.

There are several applications where it is advantageous to have the pad layer as a separate structure or appliqué which may be mounted on the outer surface of the matrix of the device. The appliqué would be aligned relative to the device and an opposing component, e.g. a circuit board, but the matrix of the device would not require orientation relative to the pad layer. FIG. 14 shows such a structure. With this structure the pad would serve as the interface between matrix 148 and the component contact. The matrix would provide the needed compliance to allow for interconnection between the components.

Figure 15:
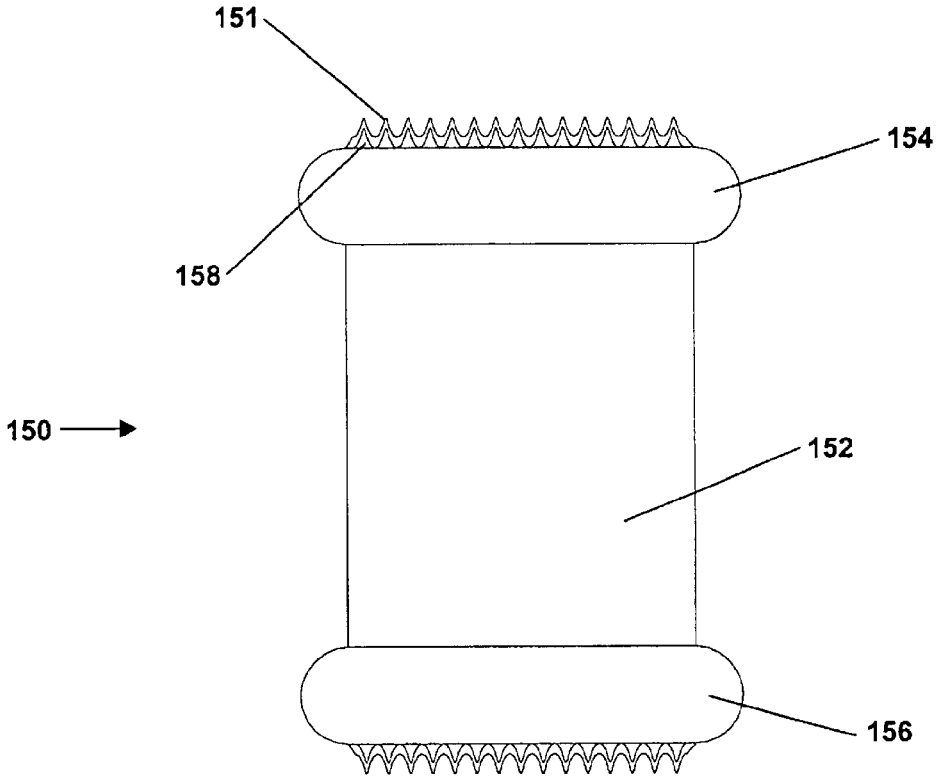
FIG. 15 is a cross-section of a floating pad shown in FIG. 11.
Figure 16:
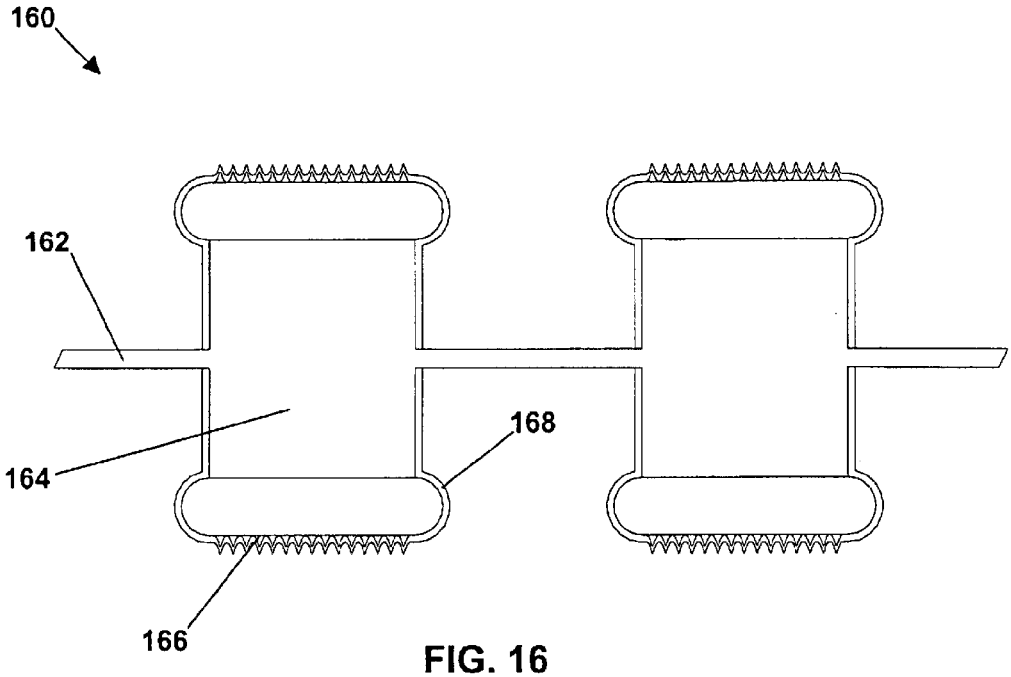
FIG. 16 is partial cross-sectional view of another preferred embodiment of an applique of floating pads of the invention.

One preferred embodiment of the appliqué, generally shown and referred to in FIG. 14 as appliqué 142 of device 140, would comprise a nonconductive sheet 144, such as Kapton, which has holes 146 formed on the same grid as the contact array. These holes would be populated by small floating pads 150. Depending on the application, these pads typically would have a diameter comparable to the land or solder ball diameter, and a height of between about 0.010 to 0.020 inch. They would have a reduced diameter middle portion 152 (FIG. 15) or "waist" and two opposing ends portions 154 and 156 which are larger in diameter than the middle portion, wherein the holes 146 of the nonconductive sheet or support layer have a diameter which is smaller than the diameters of the opposing ends, which would allow the pads to be captured in the hole in the Kapton. The compliance of the Kapton would allow for one of the ends of the pads to be actively pushed through the hole without pushing the opposing end through the hole as well. The pad floats in the hole by virtue of the reduced diameter middle portion and is retained in the hole by virtue of the larger end portions. The pad could move up and down the length of the waist while being held in place laterally.

The floating pads may be machined from metal such as brass using a screw machine tool, and barrel plated with gold or solder. Alternatively, the floating pad may be molded from plastic and plated to create the conductive path. The plating process starts with an electroless copper plate and is followed with nickel and solder or gold as needed. These plating techniques are well known to those skilled in the art of plating. The metal coatings could alternatively be applied by overmolding techniques where the molds are plated first with a metal, such as silver, before filling the molds with the plastic material. Asperities 158 (FIG. 15) may be formed on the pads by using a mold insert having a roughened inside surface and may be coated with plating 151.

In another preferred embodiment of the appliqué, shown and generally referred to as appliqué 160, sheet 162 and pads 164 are molded out of plastic, with or without molded asperities 166, and plated with conductive plate 168. The shape of the pads may be optimized to match the opposing contact. The appliqué of this embodiment may be made by inserting a Kapton carrier with holes on the component grid into a molding press where plateable conducting contacts are then molded into each of the holes. The geometry of the pads and any asperities desired would be defined by the geometry and inside surface of the molding press. The resulting contacts pads would be electrolessly plated with conductive materials that would not plate on the Kapton, providing the needed array of plated contact pads.

Alternatively, an integral molded lead frame may be used to mechanically orient the plurality of pads so that they were held on the contact grid, thus eliminating the need for the carrier sheet. The pads would be preferentially plated with the appropriate metal system to address the needs of the interconnection. The lead frame would, in its final state, not be plated, leaving it non-conductive. This can be facilitated by several different methods.

One such method utilizes a double molding process, wherein the lead frame and contact pads are molded from different plastics. The pads are be formed from a plateable plastic and the lead frame is formed from a non-plateable plastic.

In another method, the entire surface of the contact pad and lead frame would be plated with a thin flash of copper, providing a conductive path for electroplating. A non-plateable photo resist would be coated over the entire part, and processed to be removed from the contacts but remain on the lead frame. The assembly would then be electroplated with nickel, followed by gold, solder or any other suitable material, as needed. The photoresist on the lead frame is removed, and the copper flash etched from the frame, eliminating conductive paths. The etch will not attack the solder or gold finish on the contacts.

In yet another method, the contact pads are preferentially metalized by masking the lead frame and applying metal by sputtering or other form of vapor deposition.

The above described methods may be combined in numerous ways to achieve the desired geometry. One such combination would comprise the step of molding a contact pad array with lead frame attached. This entire assembly is then plated with the techniques described above. The array of contacts pads would be gang inserted into a Kapton sheet with matching holes. As the array of pads is inserted, the lead frame is removed and discarded.

Bulk Properties of Elastomer

Magnetically aligned systems, such as ACEs, use very little metal, and the material tends to take on the elastic behavior of the base elastomer. However, as noted above, the behavior of the elastomeric material is critical to the success of the device's performance. Previously used materials, such as highly filled materials, typically exhibit little residual spring force which reduces the reliability of the contact and virtually precludes multiple device insertions with different devices. In the present invention, these drawbacks are overcome by using a recently developed "perfectly" elastic base elastomers which exhibit nearly perfect elasticity over a broad temperature range. Specifically, NuSil CF1-6755 (available from NuSil Technology, Carpinteria, Calif.) has been identified as having close to ideal behavior. In a preferred embodiment, the matrix is formed from a blend of from 5% to 25% by volume of magnetically aligned particles in a base of NuSil CF1-6755 or its equivalent (by equivalent is meant an elastomeric material that retains at least 90% of its modulus of compression over a temperature range of −50° C. to 200° C.). This combination will not take a set over a wide temperature range.

When these "perfectly" elastic materials are used to interconnect components to other components, such as boards, external clamping springs such as those required by other types of sockets, are no longer required. Closure of the socket to a fixed displacement of the ACE material will establish a spring force which will remain fixed over the life of the product.

As noted, elastomers tend to behave like incompressible fluids. A distribution of space must be provided for the elastomer to flow or bulge into as the material is compressed. Several methods may be employed to form the needed flow space. For example, as noted above, the surface structure can be modified by the addition of conducting pads as described above. A volume of space is created by the thickness of the pads. These pads would be on the same grid as the contacts of the device and board. In addition, or alternatively, microspheres of compressible material, such as air filled particles, may be introduced into the matrix of elastomer.

In yet another alternative method, foamed elastomer materials may be utilized which combine the elastic properties of the NuSil silicone (available from NuSil Technology, Carpinteria, Calif.) described above with the ability to create highly controlled size and distribution gas particles throughout the elastomer matrix. Such a material, for example, is NuSil Silicone Foam CF3-2350. In a general sense, the pore size or diameter of entrained gas particle should be less than 20% the size of the conducting particle. This material will be a perfectly elastic medium which is compressible.

In yet another method for creating the elastomer sheet, the conventional practice is to use a flat carrier web. The elastomer takes on the shape of the web. A modified web may be used which has recesses (like the surface of a golf ball) on the same grid as the contact surface. The resulting sheet will have the space needed for the elastomer to flow. It may also be possible to form a carrier sheet which has a recess grid which is much finer than the intended contact grid. This will eliminate the need to orient the elastomer relative to the contact array of the device.

Flow space may also be formed by increasing the magnetic field level during ACE manufacture. This increase in the magnetic force tends to pull the magnetic particles from the surface and create columns with an extra particle thickness in the column, but will leave the rest of the elastomer sheet at its basic thickness. This extra particle protrudes from the surface of the matrix to form a convoluted surface (with erupted portions aligned with the columns), which provides additional space for the elastomer to move to during compression.

The device of the invention may be used in at least three different areas in a connector to optimize the interconnection. The device may be used between two or more components, e.g. a board, to provide electrical contact. The device may also be used a component, such as a board, and a heat sink. The latter devices are preferably highly convoluted to maximize thermal contact. These convolutions provide the space needed for the material to flow during compression. The thermal conducting material also generally comprises a higher percentage of metal particles in the matrix, preferably between about 20 to 25%, than electrically conducting material, which preferably comprises less than 12% metal particles. As a result, the thermal conducting material tends to be more isotropic than anisotropic. The use of an isotropic thermal elastomer between the device and heat sink also spreads the compressive load uniformly across the device, reducing the opportunity for damage to the device.

Alternatively, the device may be used in addition to a metal stiffener which is normally required on the back side of the printed circuit board to maintain a uniform compressive load between the board and device. An unfilled, insulating elastomer can be placed between the stiffener and board, to assure a uniform load across the surface. Although this material behaves like an incompressible fluid, it will not provide a perfectly uniform load leveling action. This can be corrected by perforating the elastomer with an array of holes. This will allow for local deformation, while assuring a uniform load distribution. Alternatively, the elastomer may be filled with compressible particles or gas particles to achieve the same effect. Without perforation of the elastomer, or creating space by one of the means described above, true load leveling cannot occur.

In addition to the applications described above, the device may be used to interconnect device package to device package; board to board; board to flex or any combination of same.

Figure 17:
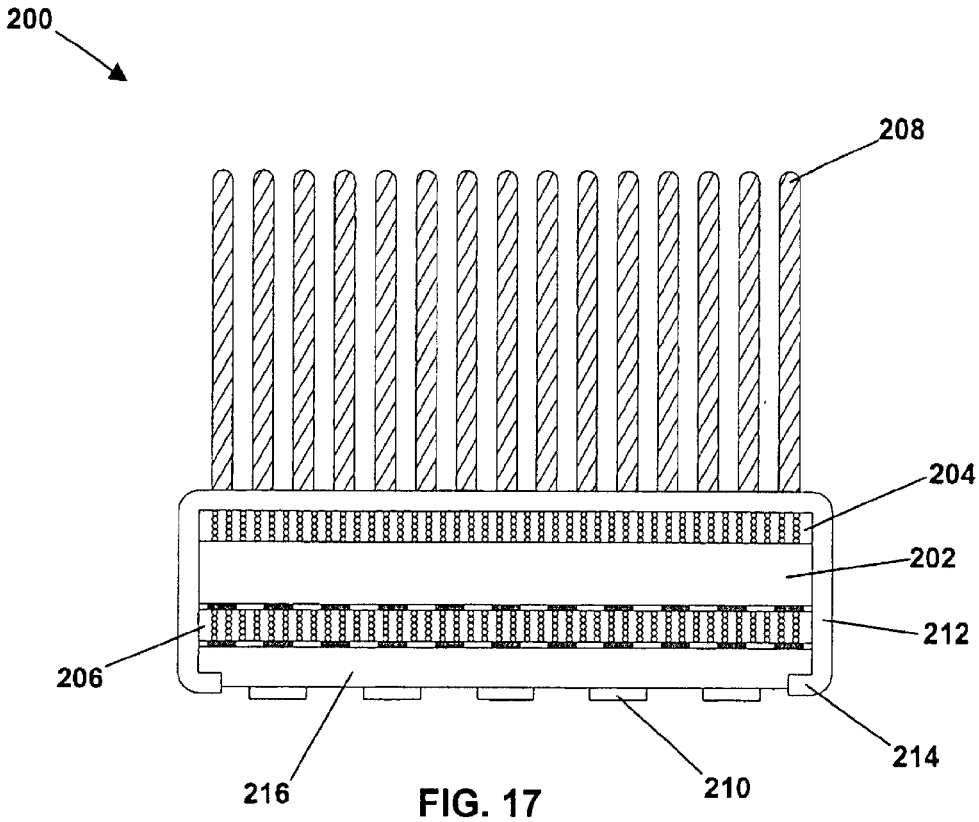
FIG. 17 is a cross-sectional view of the device of the invention in use.

These elastomeric materials can also be used in the packaging of the device with one or more components. Rather than use wire bonding to attach a component to a lead frame package or other device interconnect structure, a very fine pitch elastomer is used to attach chip 202 to the lead frame structure (FIG. 17). Device package 200 comprises chip 202 sandwiched between two layers of elastomer. A top layer 204 provides thermal contact to remove heat, via heat sink 208, from the chip, and a bottom layer 206 provides electrical contact between the chip 202's pad layer and lead frame 210. The combination of elastomers as shown provides excellent mechanical and environmental protection to the chip. Compression of the elastomer would occur as can 212 is sealed with swaged seal 214 around base 216.

The device and methods described above primarily used to create a conducting matrix for subsequent assembly into an interconnection device. However, other uses are envisioned to integrate the manufacturing of the conducting matrix directly into the board or flex circuit manufacturing process. For example, the Mylar carrier sheet may be replaced by a flex circuit. A sheet of the conducting matrix would be formed on the surface of the flex circuit and bonded to it. Interconnection of the flex to the board or device would be facilitated by compressing the flex circuit/conducting matrix to the mating contact using appropriate housing and alignment hardware.

With respect to planarization of BGA devices, the balls of solder typically have a tolerance on their thickness. The device to which they are attached may have a certain amount of warpage due to the construction process and materials used. As a result, the surface formed by the bottom of the array of solder balls is not a flat plane, but an irregular shape. The irregular shape constrains the choice of the interconnection medium because the irregular shape demands that the interconnection medium have a large dynamic range. The need for a large dynamic range limits the choices of interconnection medium and increases the system cost. However, the device of the invention may be used to make a separable connection to a BGA by a low cost modification to the package which will planarize the array, thus allowing the BGA to be readily connectorized.

Using a heated flat surface which is not wetable by solder, the BGA package is pressed against the plate. The temperature of the surface is such that the solder will soften and extrude as the solder ball is pressed against the surface, with the array of solder balls conforming to the heated plate. A controlled compression can be used such that the final dimension from the top of the package to the plane of the BGA surface is highly controlled. The resulting array of flattened solder ball surfaces would now form a true plane. This surface would now be optimized for interconnection using thin ACE materials. Furthermore, the bottoms of the balls would each have a flat surface. The balls used in the BGA package may alternatively comprise a solder-coated metal ball, rather than a ball consisting entirely of solder. For purposes of this description, the term "solder ball" refers to both pure solder balls and solder-coated metal balls.

In a preferred embodiment, the heated flat surface could be a Teflon coated hot plate with a regulated temperature control. The final thickness of the device would be controlled by a fixture attached to the hot plate, with a limiting stop which establishes the location of the array of flattened solder ball surfaces.

Generally, to carry out the method of the invention, for making an elastomeric device for electrically interconnecting two or more components, a plurality of conductive, magnetic particles are embedded in an elastomer which preferably retains 90% of its modulus of compression over a temperature range of between about −50° C. to 200° C. by mixing the particles in the elastomer before the elastomer sets and applying a magnetic force to the particles so that the particles align themselves in electrically isolated columns as the elastomer sets to form an elastomeric matrix having one or more outer surfaces and comprising one or more electrically conductive pathways through the matrix. After the particles are embedded, one or more electrically conductive contact pads are provided and fixed to the matrix so that at least a portion of one or more of the pads is flush with or extends outward from one or more of the outer surfaces of the matrix and, so that at least a portion of the pad is in at least intimate contact with one or more of the pathways. The pads may be fixed to the matrix by sputtering, vapor depositing, plating, bonding or a combination thereof, with or without the use one or more carrier sheets and/or support films. Alternatively, the pads may be fixed to the matrix as an appliqué of floating or non-floating pads using the techniques described above.

The device made by the method is enhanced by creating one or more means for providing flow space into which at least a portion of the matrix may flow under compression, wherein the step of creating one or more means for providing flow space comprising one or more of the following steps: embedding one or more microspheres in the elastomer as its sets to form the matrix; forming a plurality of raised surface asperities in one or more of the outer surfaces of the matrix as the elastomer sets; and/or trapping one or more gas particles in the matrix as the elastomer sets. The pathways formed may be anisotropic and comprise up to about 25% magnetic particles by volume of the elastomeric matrix. The pathways preferably comprise at least about 3% magnetic particles by volume of the elastomeric matrix. The method preferably utilizes a plurality of the columns of magnetic particles wherein at least one end particle proximate one or more of the outer surface of the matrix, and wherein one or more of the pads is in intimate contact with an end particle of one or more of the columns of particles, wherein the pads preferably comprise one or more layers of metal in at least intimate contact with one or more of the outer surfaces of the matrix and one or more of the pathways.

In methods in which an applique of pads are used, the pads are a known number and comprise two opposing end portions having a diameter and a middle portion having a diameter smaller than the diameter of the end portions, and wherein the step of providing one or more electrically conductive contact pads comprises the steps of, providing one or more non-conductive, pliant support sheets comprising a plurality of holes, having a diameter smaller than the diameter of the end portion of the pads, through the sheet corresponding to the number of pads; and pushing one of the opposing ends portions of each of the pads through one of the holes so that the pad is captured in the sheet.

Although specific features of the invention are shown in some drawings and not others, this is for convenience only as some feature may be combined with any or all of the other features in accordance with the invention. Other embodiments will occur to those skilled in the art and are within the following claims.

What is claimed is:

1. An elastomeric device for electrically interconnecting two or more components, comprising:

an elastomeric matrix having one or more outer surfaces;

a plurality of electrically conductive pathways through said matrix, the pathways each comprising a plurality of particles; and a plurality of electrically conductive contact pads integral with said matrix, said pads each in electrical contact with a plurality of conductive pathways, wherein at least a portion of one or more of said is flush with or extends outward from an outer surface of said matrix.

2. The device of claim 1, further comprising one or more means for providing flow space into which at least a portion of said matrix may flow under compression.

3. The device of claim 2, wherein said means for providing flow space comprises one or more compressible microspheres imbedded in said matrix.

4. The device of claim 2, wherein said means for providing flow space comprises spaces formed between a plurality of raised surface asperities on one or more of said outer surfaces of said matrix.

5. The device of claim 2, wherein said means for providing flow space comprises one or more gas particles located in said matrix.

6. The device of claim 5, wherein said pathways comprise one or more conducting particles and wherein said gas particles are of a size which is about 20% or less than the size of said conducting particles.

7. The device of claim 2, wherein said means for providing flow space comprises one or more spaces formed between two or more of said pads which extend outward from said surface of said matrix.

8. The device of claim 2, further comprising one or more asperities on one or more of said outer surfaces, wherein said means for providing flow space comprises one or more spaces formed between two or more of said asperities.

9. The device of claim 2, wherein one or more of said pathways comprises a plurality of electrically conductive particles, wherein one or more of said particles extends outward from one or more of said outer surfaces, and wherein said means for providing flow space comprises one or more spaces formed between two or more of said particles extending outward from said one or more of said surfaces.

10. The device of claim 1, wherein said pathways are anisotropic and comprise up to about 25% magnetic particles by volume of said elastomeric matrix.

11. The device of claim 10, wherein a plurality of said magnetic particles are aligned to form one or more arrays of electrically isolated columns having at least one end, wherein one or more of said pads is in contact with an end of one or more of said columns of particles.

12. The device of claim 1, wherein one or more of said pathways comprises a plurality of particles aligned to form a column having at least one end, wherein one or more of said pads is in contact with at least one of said ends of one or more of said columns of particles.

13. The device of claim 1, wherein one or more of said pads comprises one or more layers of metal in at least intimate contact with one or more of said outer surfaces of said matrix.

14. The device of claim 13, wherein said pads together form an array of electrically conductive pads across one or more of said outer surfaces of said matrix.

15. The device of claim 14, wherein at least one of said components is a circuit board comprising an array of electrical contact points, (lands), and wherein said array of pads corresponds to said array of contact points on said board.

16. The device of claim 14, wherein at least one of said components is a heat sink, and wherein said matrix is isotropic to conduct heat from said circuit board to said heat sink.

17. The device of claim 14, wherein at least one of said components is a ball grid array comprising an array of solder balls, and wherein said array of pads corresponds to said array of solder balls.

18. The device of claim 1, wherein one or more of said pathways comprises a plurality of electrically conductive particles aligned in a column having at least one end particle coated with a metal, and wherein said portion of said pad, that is in at least intimate contact with one or more of said pathways, is in contact with said coated end particle and is coated with one or more metals that is compatible with said metal coating on said end particle.

19. The device of claim 1, wherein said matrix comprises one or more elastomers which retains about 90% or more of its modulus of compression over a temperature range of between about −50° C. to 200° C.

20. The device of claim 1, wherein one or more of said pads has at least one outer surface, wherein at least a portion of said outer surface comprises one or more electrically conductive coatings.

21. The device of claim 20, wherein one or more of said coatings comprises one or more metallic layers.

22. The device of claim 1, wherein one or more of said pads has at least one outer surface comprising one or more asperities.

23. The device of claim 1, wherein one or more of said pathways comprise a plurality of conducting particles aligned in one or more columns having at least one end particle, and wherein one or more of said pads form a bond with said matrix and with one or more of said end particles.

24. The device of claim 1, wherein said outer surfaces of said matrix comprise a first surface adapted to face one of said components and a second surface adapted to face a second of said components, wherein one or more of said pathways extends from at least proximate to said first surface to at least proximate said second surface and wherein one or more of said pads are located on said first and second surfaces.

25. The device of claim 1, further comprising one or more support films.

26. The device of claim 25, wherein at least one of said support films is a carrier sheet.

27. The device of claim 25, wherein at least one of said support films is removable.

28. The device of claim 25, wherein one or more of said components comprises registration holes, and wherein at least one of said films comprises one or more registration holes in said film which correspond to said registration holes of said component.

29. The device of claim 25, wherein one or more of said components comprises registration holes, and wherein one or more of said films comprises one or more precision pins which correspond to one or more of said registration holes of said components.

30. The device of claim 25, wherein at least one of said films comprises one or more mounting holes in said film which are at least partially filled with said elastomeric matrix.

31. The device of claim 25, wherein at least one of said films comprises one or more contact holes adapted to receive therein at least one or more of said pads.

32. The device of claim 31, wherein at least one of said films is removable, which, if removed, will leave behind spaces between two or more of said pads into which at least a portion of said matrix may flow when compressed.

33. The device of claim 25, wherein at least one of said films comprises one or more contact holes adapted to receive therein at least one or more of said pads, and wherein at least one or more of said pads has an outer surface which protrudes from said contact holes.

34. The device of claim 25, wherein at least one of said films comprises one or more contact holes adapted to receive therein at least one or more of said pads, and wherein at least one or more of said pads has at least an outer surface which is exposed and coated with one or more metals.

35. The device of claim 1, wherein a plurality of said pads are mounted to said matrix as an applique.

36. The device of claim 35, wherein said applique comprises a support layer which holds one or more of said pads in one or more predetermined locations in said support layer.

37. The device of claim 36, wherein one or more of said pathways comprise a plurality of conducting particles aligned in one or more columns having at least one end particle proximate one or more of said outer surfaces of said matrix, wherein said predetermined locations correspond to one or more of said end particles.

38. The device of claim 36, wherein said support layer comprises two opposing sides, wherein one or more of said pads which is held in said support layer comprises two opposing ends portions which are larger in diameter than a middle portion, wherein said holes of said support layer have a diameter which is smaller than the diameters of said opposing ends, and wherein said larger opposing end portions of one or more of said pads extend outward from said opposing sides of said support layer and said middle portion of said pad is captured in said hole.

39. The device of claim 38, wherein said middle portion of said pad has a length and said pad is capable of floating up and down in said hole to the extent of said length of said middle portion.

40. The device of claim 38, wherein said pads are brass.

41. The device of claim 38, wherein said pads are molded plastic and comprise one or more conductive layers.

42. The device of claim 41, wherein said conductive layers comprise a layer of copper and one or more subsequent layers of nickel and solder.

43. The device of claim 41, wherein said conductive layers comprise a first layer of copper, a second layer of nickel and one or more subsequent layers of gold.

44. The device of claim 38, wherein said pads have one or more surfaces and comprise one or more asperities in one or more of said pad surfaces.

45. The device of claim 38, wherein said pads comprise conductive plastic.

46. A method for making an elastomeric device for electrically interconnecting two or more components, comprises the steps of, embedding a plurality of conductive, magnetic particles in an elastomer which retains 90% of its modulus of compression over a temperature range of between about −50° C. to 200° C. by mixing said particles in said elastomer before said elastomer sets and applying a magnetic force to said particles so that said particles align themselves in electrically isolated columns as the elastomer sets to form an elastomeric matrix having one or more outer surfaces and comprising one or more electrically conductive pathways through said matrix;

providing one or more electrically conductive contact pads; and fixing one or more of said electrically conductive contact pads to said matrix, so that at least a portion of one or more of said pads is flush with or extends outward from one or more of said outer surfaces of said matrix and, so that at least a portion of said pad is in at least intimate contact with one or more of said pathways.

47. The method of claim 46, further comprising the step of creating one or more means for providing flow space into which at least a portion of said matrix may flow under compression.

48. The method of claim 47, wherein said step of creating one or more means for providing flow space comprises embedding one or more compressible microspheres in said elastomer as its sets to form said matrix.

49. The method of claim 47, wherein said step of creating one or more means for providing flow space comprises forming a plurality of raised surface asperities in one or more of said outer surfaces of said matrix as said elastomer sets.

50. The method of claim 47, wherein said step of creating one or more means for providing flow space comprises the step of trapping one or more gas particles in said matrix as said elastomer sets.

51. The method of claim 46, wherein said pathways are anisotropic and comprise up to about 25% magnetic particles by volume of said elastomeric matrix.

52. The method of claim 51, wherein a plurality of said columns of magnetic particles has at least one end particle proximate one or more of said outer surface of said matrix, and wherein one or more of said pads is in intimate contact with an end particle of one or more of said columns of particles.

53. The method of claim 51, wherein said pathways comprise at least about 3% magnetic particles by volume of said elastomeric matrix.

54. The method of claim 46, wherein one or more of said pathways has at least one end particle, and wherein one or more of said pads is in intimate contact with at least one of s aid end particles of one or more of said columns of particles.

55. The method of claim 46, wherein one or more of said pads comprises one or more layers of metal in at least intimate contact with one or more of said outer surfaces of said matrix and one or more of said pathways.

56. The method of claim 46, wherein said pads are a known number and comprise two opposing end portions having a diameter and a middle portion having a diameter smaller than said diameter of said end portions, and wherein said step of providing one or more electrically conductive contact pads comprises the steps of, providing one or more non-conductive, pliant support sheets comprising a plurality of holes, having a diameter smaller than said diameter of said end portion of said pads, through said sheet corresponding to said number of pads; and pushing one of said opposing ends portions of each of said pads through one of said holes so that said pad is captured in said sheet.

57. A device package, wherein one or more chips and one or more components are electrically interconnected, comprising, one or more layers of elastomeric material between said chip and said component, wherein at least one of said layers provide electrical contact between said chip and said component, and wherein said layer which provides electrical contact comprises, an elastomeric matrix having one or more outer surfaces;

one or more electrically conductive pathways through said matrix; and one or more electrically conductive contact pads, wherein at least a portion of said pad is in at least intimate contact with one or more of said pathways.

58. A device package, wherein one or more chips and one or more heat sinks are interconnected so that heat may be transferred from said chip to said heat sink, comprising, a can having a first and second opposing surface, wherein said first opposing surface is adjacent to said heat sink;

a top layer of elastomeric material provided between said chip and said second opposing surface of said can, wherein said top layer provides thermal contact between said chip and said can;

a bottom layer of conducting elastomeric material between said chip and a lead frame, wherein said bottom layer provides electrical contact between said chip and said lead frame.

59. The device package of claim 58, wherein said bottom layer comprises elastomeric conducting polymer interconnect.

* * * * *

UNITED STATES PATENT AND TRADEMARK OFFICE

CERTIFICATE OF CORRECTION

PATENT NO. : 6,854,985 B1
APPLICATION NO. : 09/465056
DATED : February 15, 2005
INVENTOR(S) : Roger E. Weiss It is certified that error appears in the above-identified patent and that said Letters Patent is hereby corrected as shown below:

Column 15, line 66, should read
"least a portion of one or more of said --pads-- is flush with or"

Signed and Sealed this

Twenty-second Day of July, 2008

JON W. DUDAS
*Director of the United States Patent and Trademark Office*